US008646635B2

(12) United States Patent
Mavin et al.

(10) Patent No.: US 8,646,635 B2
(45) **Date of Patent: *Feb. 11, 2014**

(54) SCALLOP CAP CLOSURES

(75) Inventors: Gerry Mavin, Northumberland (GB); Tim Stephenson, South Yorkshire (GB)

(73) Assignee: Portola Packaging, Inc., Naperville, IL (US)

( * ) Notice: Subject to any disclaimer, the term of this patent is extended or adjusted under 35 U.S.C. 154(b) by 351 days.

This patent is subject to a terminal disclaimer.

(21) Appl. No.: 12/981,134

(22) Filed: Dec. 29, 2010

(65) Prior Publication Data

US 2011/0114594 A1 May 19, 2011

Related U.S. Application Data

(63) Continuation of application No. 11/561,016, filed on Nov. 17, 2006, now Pat. No. 7,891,511.

(60) Provisional application No. 60/803,997, filed on Jun. 6, 2006.

(30) Foreign Application Priority Data

Nov. 22, 2005 (GB) ..... 0523725.0

(51) Int. Cl.
*B65D 41/48* (2006.01)

(52) U.S. Cl.
USPC ..... 215/305; 215/256; 215/317; 220/780

(58) Field of Classification Search
USPC ..... 215/256, 317, 305, 329; 220/782, 784, 220/4.24, 4.25, 780
See application file for complete search history.

(56) References Cited

U.S. PATENT DOCUMENTS

| | | | | | |
|---|---|---|---|---|---|
| 4,407,426 | A * | 10/1983 | McLaren et al. | ..... | 220/781 |
| 4,702,389 | A * | 10/1987 | Bozinovich et al. | ..... | 220/784 |
| 4,711,365 | A * | 12/1987 | Fomby | ..... | 220/288 |
| 5,370,270 | A * | 12/1994 | Adams et al. | ..... | 222/88 |
| 5,687,865 | A * | 11/1997 | Adams et al. | ..... | 215/253 |
| 6,416,547 | B1 * | 7/2002 | Erickson et al. | ..... | 623/2.11 |
| 2002/0100742 | A1 * | 8/2002 | Jourdin | ..... | 215/274 |
| 2003/0155361 | A1 * | 8/2003 | Jones et al. | ..... | 220/288 |

* cited by examiner

*Primary Examiner* — Anthony Stashick
*Assistant Examiner* — James N Smalley
(74) *Attorney, Agent, or Firm* — James P. Hanrath; Adam K. Sacharoff

(57) ABSTRACT

The present invention is directed to a closure for a container. In one of the embodiments provided herein, the closure is provided with a roof portion, a shoulder portion that merges with the roof portion, and a skirt portion depending from the shoulder portion. Provided on the shoulder portion are recessed regions and full-depth regions. The recessed regions and full-depth regions alternate around the shoulder portion and are provided for improving a number of manufacturing, costs, and structural factors. In another embodiment provided herein, the closure is provided with a cylindrical skirt depending substantially from a roof portion, the cylindrical skirt having an inner wall with a plurality of narrow, elongated, vertical stand-off ribs thereon, the ribs having an upper edge below a tension ring and a lower edge below the upper edge and an elongated length causing the lower edge to be positioned about 50% to 25% above a bottom edge defined by the cylindrical skirt and measured against the entire length of the cylindrical skirt.

26 Claims, 7 Drawing Sheets

SCALLOP CAP CLOSURES

CROSS-REFERENCE TO RELATED APPLICATIONS

This application is a continuation of U.S. patent application Ser. No. 11/561,016 filed Nov. 17, 2006 now U.S. Pat. No. 7,891,511 which claims priority to U.S. Provisional Patent Application 60/803,997 filed Jun. 6, 2006, and which also claims priority to a foreign UK Patent Application No. 0523725.0 filed on Nov. 22, 2005.

BACKGROUND

This invention relates to a closure for a container, and particularly to, a container used in the water bottling industry for water dispensers and water coolers, such as a five-gallon container.

Drinking water has been supplied to consumers for many years in large containers, which typically have volumes ranging from 2.5 to 6 gallons. These large containers are often mounted upside down on a dispensing device which may also cool or heat the water as desired. The dispensing devices also permit facile dispensing of the water. A typical large container has an upstanding neck, defining an opening for the container, and has an external snap formation for engagement with a closure. Closures for the large containers are also known and typically include a roof portion, a shoulder portion depending downwardly from the roof portion, and a skirt portion depending downwardly from the shoulder portion. Internally, the closure has a snap bead, located generally at the intersection between the skirt portion and the shoulder portion, for complementary engagement with the snap formation on the container neck.

The closure may either be a "flat-roof" or a "non-spill" closure, both of which are known in the industry. A flat-roof closure has a generally flat, closed-off roof portion, which is in the form of a disc. The flat-roof closure therefore needs to be removed from the neck of the container in order to discharge the fluid or contents of the container.

There is a relatively high degree of standardization in the water bottling industry, such that most closures for large containers have many corresponding, or similar features. In addition, many of the dimensions for closures are required to lie within relatively tight tolerances, in order for the closures to provide an effective liquid-tight seal on a range of conventional container neck finishes. Accordingly, design freedom for such closures is limited.

Because closures of this type need to fit over a relatively large neck and provide a reliable seal to a high-volume container, the closures tend to be relatively bulky and heavy. It would nevertheless be desirable to be able to reduce the weight of a closure. One approach would be to reduce the overall wall thickness of the closure. While it is possible to mold a closure having an overall thinner wall thickness, this has resulted in a number of problems. First, by providing thinner walls, the closures are weaker and more prone to cracking under stress. Second, the wall of the closure is more susceptible to being deformed when the thinned-walled closure is urged onto a container neck, because the force applied can be sufficient to deform the shoulder portion, which also causes a corresponding deformation of the internal snap bead. These deformations may prevent correct application of the closure onto the container neck and lead to an inadequate seal being fowled.

In order to counter this problem, such a closure is generally formed with an internal snap bead diameter that is greater than would otherwise be required for the snap bead to engage a conventional container neck snap formation. Therefore, even when the closure is applied to a container neck correctly (i.e. without being deformed in the above manner) the quality of the seal provided may be limited by the difference between the diameters of the closure's snap bead and the external snap formation on the container neck.

A further concern regarding closures for large containers is the relatively large amount of material mass incorporated into the closure, especially in light of their single use. As explained more fully below, certain portions of the closure incorporate relatively thick cross sections for historical functional reasons. This is wasteful and uneconomical because as technology evolved, some of the reasons for these thick sections no longer apply. Therefore, it is desired to have closures aimed at savings in weight, processing time, and even improved appearance, but which is still capable of providing an effective seal and capable of maintaining its integrity.

SUMMARY OF THE INVENTION

According to one aspect of the invention, there is provided a closure for a container. The closure is provided with a roof portion, a shoulder portion that merges with the roof portion, and a skirt portion depending from the shoulder portion. Provided on the shoulder portion is an external surface that includes at least one first section having a first wall dimension, and at least one recessed region having a second wall dimension less than the first wall dimension.

The closure may also include an injection point defined on the roof portion. The injection point corresponds to an injection site made during the injection mold process. In this instance, the shoulder would include a location that is furthest from the injection point and includes a first section having the first wall dimension. Furthermore, the closure may include a weld joint being formed at the same location. The weld joint may also be set at an angle offset from the center portion on the roof.

The closure may further include recessed regions and first sections arranged such that if a plane perpendicular to the roof portion passed through both the injection point and the center of the roof portion the plane would intersect the shoulder portion at a first section. The closure may however include recessed regions and first sections arranged such that the plane would intersect the shoulder portion at a first section and a recessed region.

The arrangement and design of the recessed regions and first sections may be such that the two are alternating around the circumference of the shoulder. The recessed regions may further be spaced at equal intervals around the periphery of the shoulder. The recessed regions may also be angular. The recessed regions may further be defined as having an outer edge and a recess centre, and a wall dimension that varies smoothly from the first wall dimension at its outer edge to a second wall dimension at the recess centre.

In yet another embodiment, a cap is provided to include a plurality of narrow, elongated, vertical stand-off ribs on the inner wall of the cylindrical skirt. The ribs have an upper edge below a tension ring and a lower edge below the upper edge and an elongated length causing the lower edge to be positioned about 50% to 25% above a bottom edge defined by the cylindrical skirt and measured from the total length of the cylindrical skirt. The cap may further include a score line defined on a first portion of the cylindrical skirt and a release tab extending from the cylindrical skirt, such that a portion of the cylindrical skirt may be torn. Furthermore, the ribs would be placed substantially opposite from the release tab. Each rib would include a profile defined as having a maximum thickness at a position between the upper edge and the lower edge and diminishing continuously from the maximum thickness to a first minimum thickness substantially at the upper edge and to a second minimum thickness substantially at the lower edge, the profile slanting continuously from the maximum thickness to the first and second minimum thicknesses. The first minimum thickness and the second minimum thickness may be substantially the same. Alternatively, the base may have a first width defined at the upper and lower edges and a second width defined at a positioned between the upper and lower edges.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DESCRIPTION OF PREFERRED EMBODIMENTS

Figure 1:
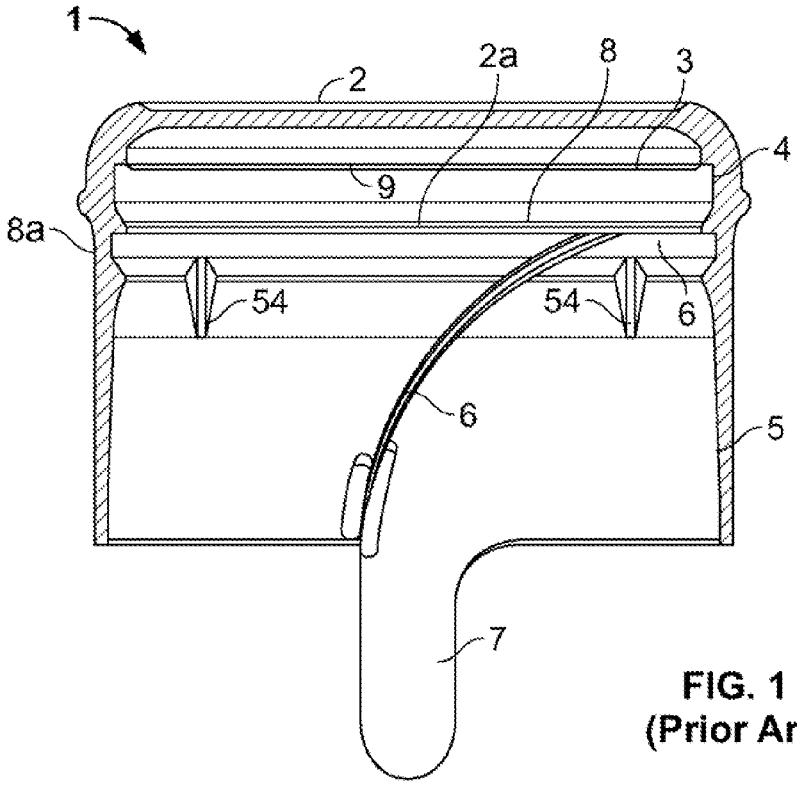
FIG. 1 (Prior Art)
FIG. 1 is a sectional view of a prior art closure commonly used with a large container.

The aspects of the instant invention will now be described in detail in conjunction with the descriptive figures. While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or the embodiments illustrated.

Figure 2:
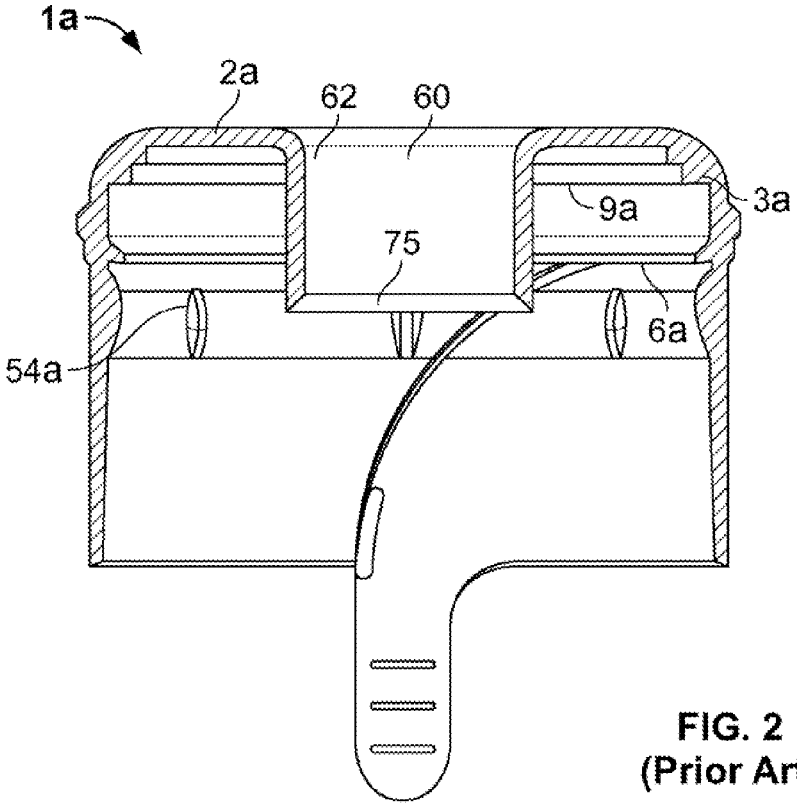
FIG. 2 (Prior Art)
FIG. 2 is a sectional view of one component, the "primary cap" of a prior art "non-spill" closure commonly used on a large container.

Prior art FIGS. 1 and 2 show closures currently used with large containers. FIG. 1 is a sectional view of a "flat-roof" closure. This type of closure is removed from the container prior to mounting on the dispensing apparatus. The closure 1 has a roof portion 2 and has a shoulder portion disposed outwardly from the roof portion 2. The shoulder portion includes a rounded corner 3, below which is a downwardly depending side wall 4. Depending from the side wall 4 is a skirt portion 5. The roof portion 2 is in the form of a circular disc. A tension ring 8, such as snap bead 8*a*, is located on the inside of the closure 1. The snap bead 8*a* is in a position to fit under the snap formation on the neck of a container (not shown in FIG. 1) and to draw the internal surface of the corner 3 towards the snap formation of the neck. The internal surface of the corner 3 is provided with an internal seal bead 9, which engages a lip (not shown) defined by the container to seal against leakage. A release tab 7 extends downwardly from the bottom edge of the skirt portion 5 for removal of the closure 1 from the neck of the container. By pulling upwards on the tab 7, the skirt portion 5 may be torn along score lines 6 so that the skirt portion releases its grip on the container neck.

The closure 1 also is shown to have narrow "application ramps" 54 projecting slightly above the internal surface formed by the snap bead 8*a*. These application ramps were first taught in U.S. Pat. No. 4,911,316 which is hereby incorporated in its entirety by reference. In the '316 patent, such ramps on the tension bead are used to accommodate bottles of varying structural geometries. It was subsequently found that the ramps serve an additional function in facilitating capping of the container. The raised ramps also serve to remove the surface of the snap bead 8*a* slightly from the surface of the container neck locking bead (not shown in FIG. 1) as the cap 1 is pushed onto the neck. Without the ramps 54 the snap bead 8*a* and container locking bead may form an airtight seal during expansion of the snap bead 8*a* over the outwardly directed container locking bead. The airtight seal prevents venting of air still remaining in the head space of the container, creating an internal pressure which can impede facile capping.

Figure 3:
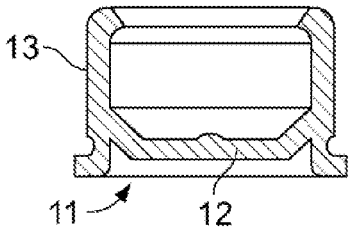
FIG. 3 (Prior Art)
FIG. 3 is a sectional view of a complimentary component, the "secondary cap", used in conjunction with the component embodied in FIG. 2.

FIG. 2 is a sectional view of a "non-spill" closure 1*a*. Many of the features of the "non-spill" type closure 1*a* are similar to those of the "flat roof" closure 1 depicted in FIG. 1. In this specification, similar features among embodiments will be identified by the same numeral plus a letter designation indicative of the particular embodiment. In the FIG. 2 closure 1*a*, it is seen that the roof portion 2*a* is in the form of an annular disk, with a central well 60 formed therein. The well 60 has a cylindrical side wall 62 which extends down into the closure 1*a* to an open end 75. Fitted snugly within the well 60 is a displaceable plug 11, illustrated in FIG. 3. The plug 11 has a bottom 12 and a side wall 13 which when placed in the well 60 of closure 1*a* closes the open end 75.

Figure 4:
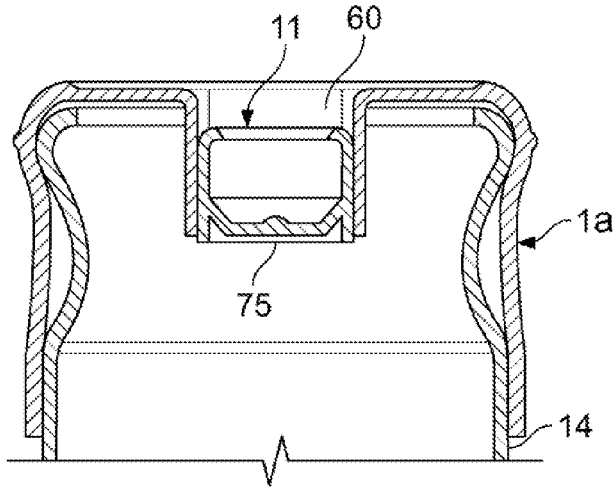
FIG. 4 (Prior Art)
FIG. 4 is a sectional view of the assembly of the components shown in FIGS. 2 and 3 as applied to the neck of a large container.

The assembly of plug 11 and closure 1*a* is illustrated in FIG. 4. In FIG. 4, the plug 11 has been inserted into the originally open end 75 of well 60 in order to the seal the well 60 and complete the closure system. The completed closure is further shown mounted to a typical neck 14 of a container.

Figure 5:
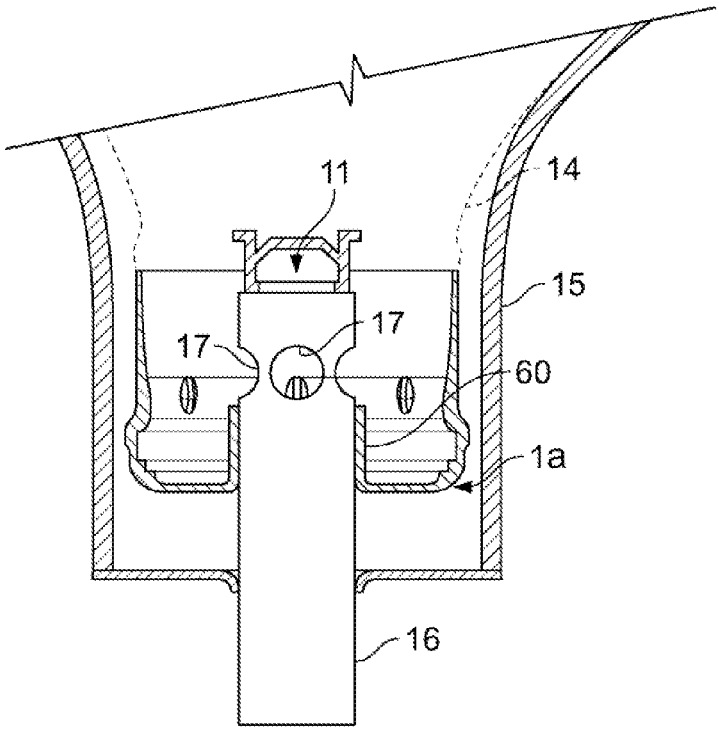
FIG. 5 (Prior Art)
FIG. 5 is a partial sectional view of the assembly of FIG. 4 after being inverted and mounted on a prior art dispensing apparatus.

FIG. 5 illustrates the situation which results when the assembly of FIG. 4 is inverted and lowered onto a dispensing apparatus equipped to cooperatively function with the "non-spill" type closures. In FIG. 5, the container has been lowered into receptacle 15 whose dimensions help position the container neck 14 axially over a hollow probe 16. The probe 16 enters the well 60 of the closure 1*a* as the container is lowered onto the dispensing apparatus. Eventually, complimentary features on the plug 11 and probe 16 interact to result in attachment of the plug 11 to the probe 16. In its final position, the probe 16 has penetrated into the container neck 14 sufficiently to displace the plug 11 and expose ports 17 to the contents of the container. Fluid is then able to enter the inside region of probe 16 through the ports 17 and flow downwardly for dispensing.

A more detailed description of the structural details and function of the closure, container, and dispensing features embodied in FIGS. 2 through 5 are presented in U.S. Pat. No. 5,232,125.

Figure 6A:
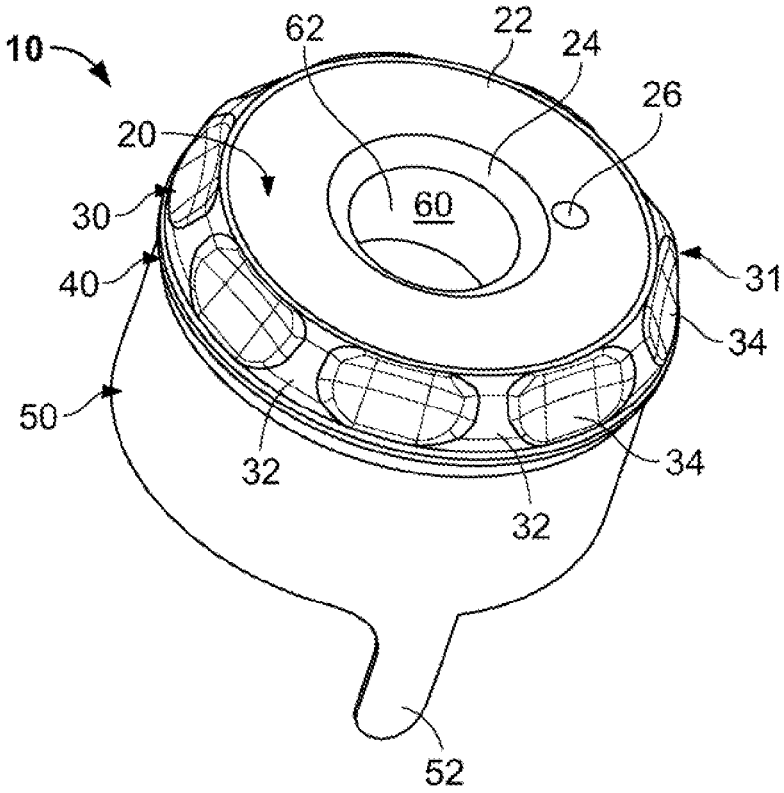
FIGS. 6*a* and 6*b* are schematic perspective views of a non-spill closure according to one embodiment of the invention.
Figure 6B:
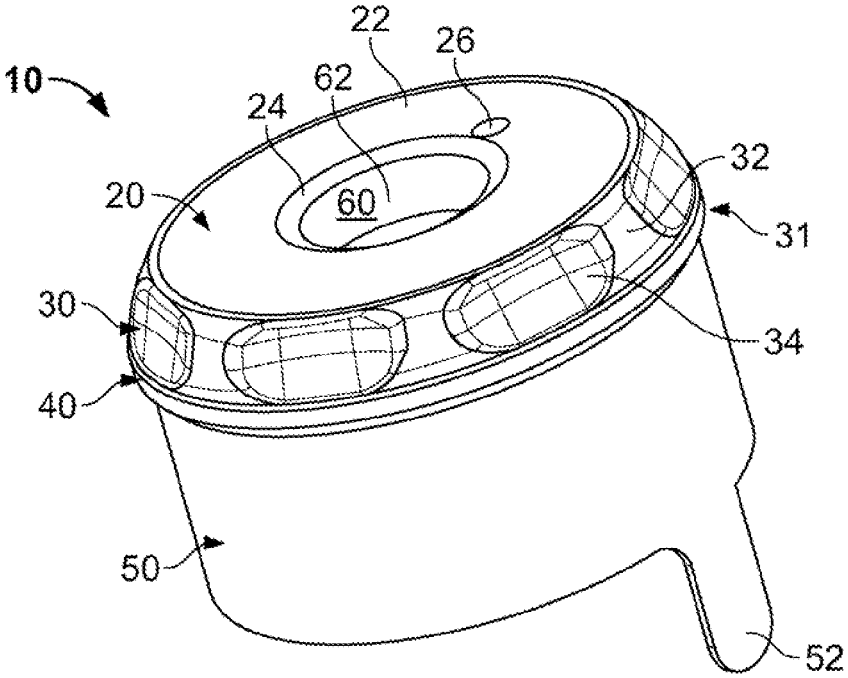

Referring now to FIGS. 6*a* and 6*b*, there is shown a closure 10 according to a first embodiment of the invention. The closure 10 has a roof 20 that includes an outer edge. Depending downwardly from the outer edge of the roof 20 is a shoulder 30, which has a lower edge and a generally cylindrical skirt 50 depending downwardly therefrom.

In the embodiment of FIGS. 6*a* and 6*b*, the closure 10 is a non-spill closure. Accordingly the roof 20 is in the form of an annular disc 22, which terminates at an outer edge that intersects with the shoulder 30. The disc 22 further has an inner edge 24 that may be sloped or rounded and intersects with a well 60. The well 60 is formed by a generally cylindrical side wall 62, which depends downwardly from the inner edge 24 of the annular disc 22.

On the surface of the annular disc 22 is an injection point 26. This is a minor irregularity in the otherwise generally planar surface of the annular disc 22 and results from the molding process used to fabricate the closure 10. A remnant 26 corresponds to the part of the closure 10 which was coincident with the injection point, or injection gate (not shown), from which molten resin was introduced into the mold. The size of the remnant 26 is typically of the order of 1 to 5 mm.

The shoulder 30 has an external surface 31 on which is formed a plurality of full-depth wall sections 32 and a plurality of recesses 34. The recesses 34 are preferably separately spaced between two adjacent full-depth wall sections 32. The number of recesses and full-depth wall sections will most likely depend on the intended application, the closure dimensions, and the choice of resin for the closure. Preferably, however, three or more recesses and full-depth wall sections are formed around the shoulder, since this provides a more balanced strut-like connection between the roof 20 and the skirt 50 of the closure 10. In any event, should weld line integrity be a concern, positioning a full thickness region (such as a full-depth wall section) at the position of the weld line should be considered for reasons explained in detail below. In the embodiment shown, there are eight full-depth wall sections 32 and eight recesses 34, ordered alternately around the shoulder 30. In this embodiment, the recesses 34 are angular and spaced regularly around the periphery of the closure 10. This arrangement has been found to provide a significant weight reduction for the closure while maintaining its integrity.

The shape of the full-depth wall sections 32 is such that the sections form a rounded corner between the roof 20 and the skirt 50. Without the recesses 34, the shoulder 30 would be formed of a single full-length wall section, generally of a conventional form. The full-depth wall sections 32 accordingly provide structural strength to the shoulder 30, in particular when transmitting forces from the roof 20 to the skirt 50 upon application of the closure 10 to a container neck (not shown).

Although in principle any size of full-depth wall sections 32 could be used, it is preferable for the circumferential extent of each full-depth wall section 32 to be greater than about 3 mm in order to provide such a strut-like effect to the closure 10. It will be appreciated that the greater the circumferential extent, the stronger that section of the shoulder 30 will be. Accordingly, the number and circumferential extent of the full-depth wall sections 32 are to be balanced with the desire to reduce the weight of the closure 10 by means of recesses 34.

The thickness of the full-depth wall sections 32 does not have to be uniform around the shoulder. Preferably, however, these wall sections 32 have an average thickness of about 2 mm. In addition, the thickness of the wall at the recesses 34 does not need to be identical for each recess. However, preferably the recesses 34 are identical in shape and thickness for aesthetic reasons and ease of manufacture. Preferably, the thickness at the center of the recess 34 is greater than about 0.5 mm, but at least thick enough for the closure 10 to maintain an adequate and secure seal.

Each recess 34 is disposed between a pair of full-depth wall sections 32. In this embodiment, the recess 34 has a shallow, shell-like or "scalloped" shape. The wall thickness of the shoulder 30 is arranged to vary smoothly from the full-depth thickness at a wall section 32 down to a minimum wall thickness at the center of each recess 34. The smooth variation in the external surface 31 facilitates molding of the closure 10 and reduces the occurrence of weak points around the shoulder 30.

The formation of one or more indentations or recesses 34 in the external surface 31 of the shoulder 30, while maintaining one or more other parts of the shoulder 30 at normal or full thickness, provides multiple advantages. First, the closure 10 requires a reduced amount of resin to mold the closure 10 and therefore has a reduced weight in comparison, for example, to the closures of FIGS. 1 and 2. Although it will be appreciated that the wall thickness of the full-depth wall sections 32 may not be entirely constant around the shoulder 30, the thickness of the wall sections 32 is generally about 1.5 to 3.0 mm. This wall thickness reduces to about 0.8-0.85 mm at the center of each recess 34. Of course, the wall thickness at the center of a recess 34 may be greater or smaller than this. It is also not necessary for each recess 34 or each full-depth wall section 32 to have the same central wall thickness. Depending on the application for the closure, these dimensions may vary. However, with the above dimensions, it is possible to reduce the weight of a closure by up to 10 percent or more compared with known closures. This represents a saving of up to around 1 gram of resin per closure, which is a significant reduction in material usage.

Another advantage of the novel arrangement of recesses 34 is improved manufacturing. With less resin required per closure 10, less time may be taken to inject the resin into the closure molds and less time may be required for the closures 10 to cure, so that the manufacture of such closures 10 becomes more efficient. This can, in turn, lead to a greater yield per unit time and/or manufacturing cost savings. The manufacturing cycle times are not only improved as a result of the better cooling characteristics for the closure, but also as a result of the greater ease with which the molded closures 10 may be ejected from the molding tool. This again provides economic and environmental advantages.

Although regions of the shoulder 30 are formed with reduced thickness walls, the integrity of the closure 10 is maintained by the one or more full-depth wall sections 32. In this way, unwanted deformation of the closure 10 upon application to a container neck may be avoided. The full-depth wall sections 32 may also act like struts to maintain the general rigidity of the closure 10 during application to a container neck, while permitting the closure 10 to flex as required to overcome a snap engagement formation on the container neck.

As previously mentioned, the skirt 50 is generally cylindrical and sized so as to fit tightly around the neck of a container (not shown) to which it is applied in a conventional manner. Also conventional, a release tab 52 extends longitudinally downwardly from the skirt 50. Tear lines or score lines (not shown) are applied to the closure 10 during the molding process. These extend upwardly from the release tab 52, on the surface of the skirt 50. When the release tab 52 is pulled upwards towards the roof 20, the tear lines fracture, tearing the skirt 50 and facilitating removal of the closure 10 from a container neck. At the intersection between the shoulder 30 and the skirt 50 there is provided an external bead 40. The bead 40 facilitates the manual lifting of the full container of fluid.

Figure 7A:
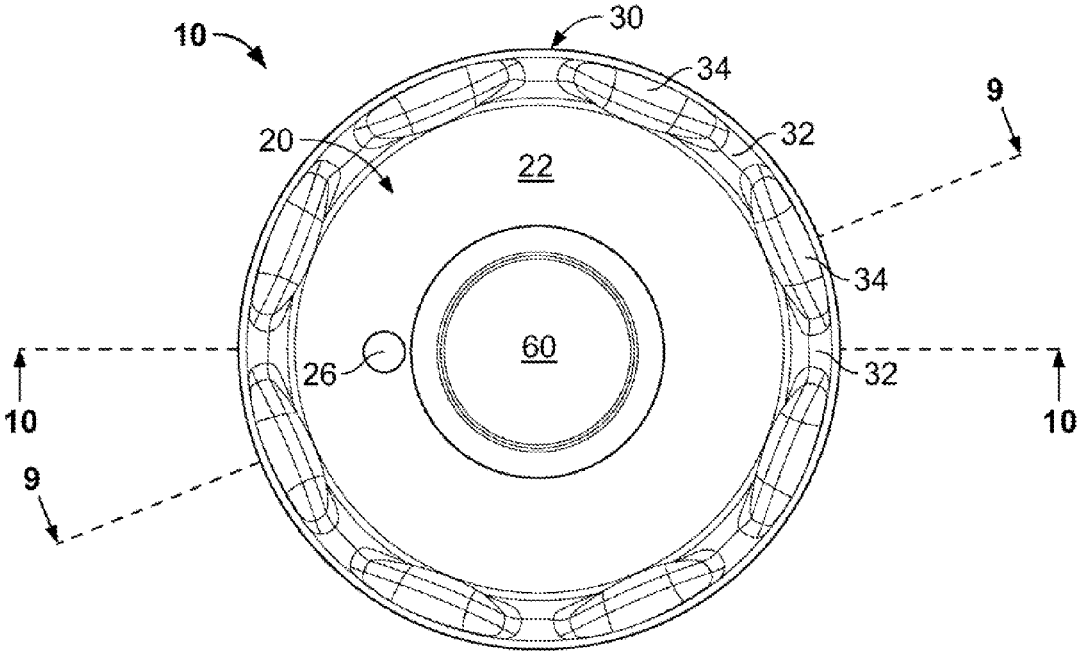
FIGS. 7*a* and 7*b* are schematic top views of the closure of FIGS. 6*a* and 6*b;*
Figure 7B:
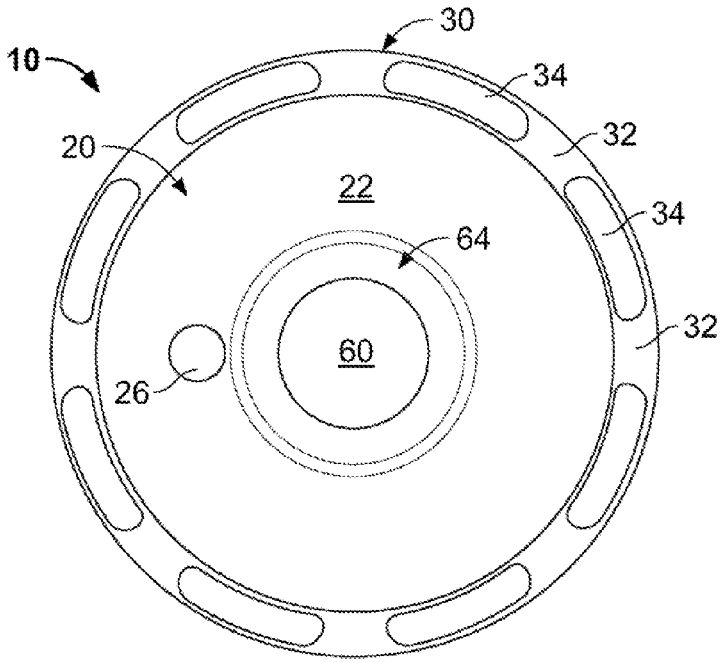

FIGS. 7*a* and 7*b* show top views of the closure 10 shown in FIGS. 6*a* and 6*b*, respectively. Here, the inside of the well 60 can be seen. At a lower end of the well 60 is a plug 64. The bottom end of the well can be initially sealed by a plug, as embodied in FIG. 4, or by other structural designs.

Figure 8A:
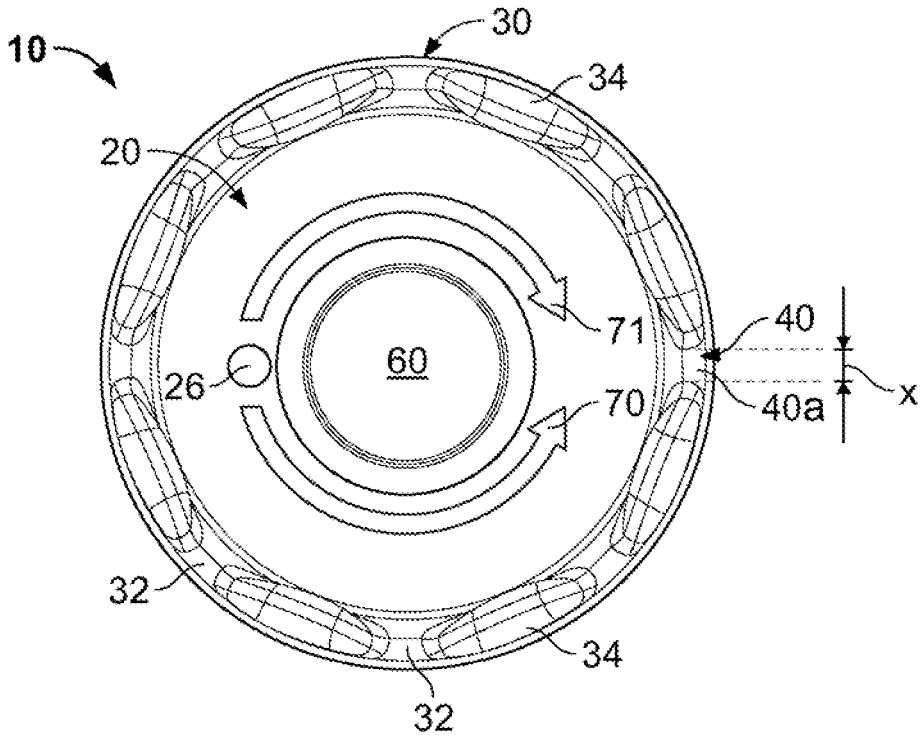
FIG. 8*a* is a schematic top view of the closure of FIGS. 6*a* and 6*b*, illustrating resin flow path directions.

FIG. 8*a* shows a similar view to the view shown in FIG. 7*a*, but also illustrates flow paths of the resin when a closure 10 is injection molded. The well 60 is located centrally in the roof 20 of the closure 10. Accordingly, the injection point of the injection molding apparatus needs to be off center and is located at a position corresponding to injection point 26. When the molten plastic is injected into the mold the plastic flows out of the injection point to fill the mold. As it does so, the material flow splits and follows in paths generally illustrated by arrows 70 and 71. As the resin flows around the mold, the two flow paths meet at the opposite side of the mold to the injection point, generally at the farthest point away from the injection point in the mold. The flow paths therefore form a weld joint at this location 40. In order to ensure that the weld joint has adequate strength the location 40 is arranged in this embodiment to coincide with a full-depth wall section 32. In this way, there is enough material at the location 40 for a reliable weld to be formed, thereby preventing the possible formation of weak points in the closure.

Given the flow characteristics of the resin in the injection mold, the weld joint 40*a* is generally formed in a longitudinal direction (i.e. generally perpendicular to the plane of the diagram shown in FIG. 7). The full-depth wall section 32 disposed at the location 40 is not reduced in thickness in this longitudinal direction so that the closure 10 may maintain its integrity at the weld joint 40*a*. As mentioned above, the circumferential extent of a full-depth wall section 32 is preferably about 1.5 mm or greater. The circumferential extent of the wall section 32 disposed at the location 40 is marked in FIG. 8*a* with the symbol "X". Where the dimensions of the closure are different, for application to containers of different sizes, it is preferable for the wall sections to subtend an angle at the center of the roof in the range between 5 degrees and 25 degrees. In this way, the wall section X is provided with sufficient plastics material, both longitudinally and laterally, to maintain the strength of the closure 10 at the side opposite the injection point 26.

In order for the above closure arrangement to be achieved, it is preferred that the location on shoulder 30 which is furthest from the injection point 26, location 40, correspond to one of the relatively thicker wall sections 32 of the shoulder. In other words, it should be possible to define a line, which passes from the injection point 26, substantially through the center of the roof 20, and terminates in a full-depth wall section 32. In this way, the weld joint 40*a* formed longitudinally in the closure 10 is formed through a full-depth section 32 and not through a thin walled recess 34.

Figure 8B:
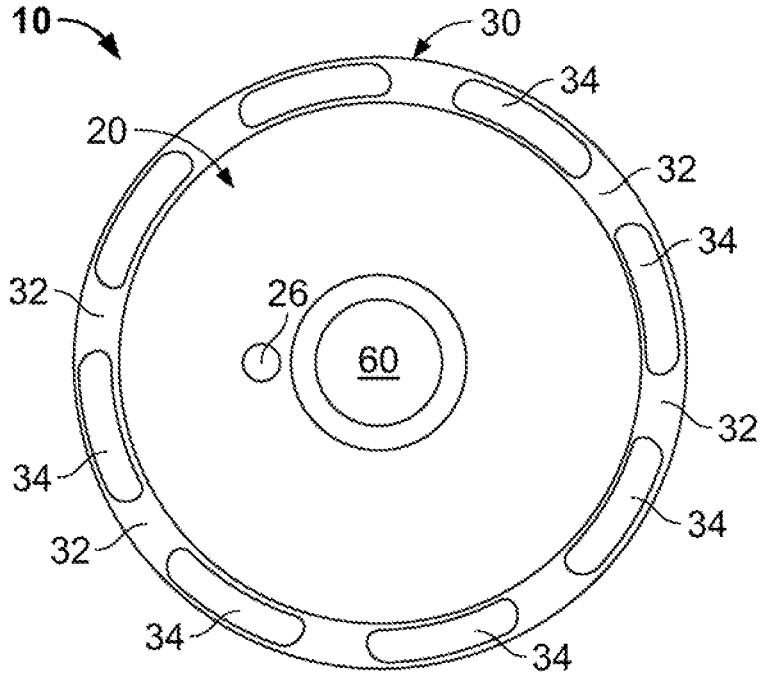
FIG. 8*b* is a schematic top view of a closure, illustrating alternative placement for the full-depth and recessed wall sections.

FIG. 8*b* shows an alternate closure top, illustrating a plurality of walled recesses 34 and full-depth sections 32. In this embodiment, a walled recess 34 is placed near the injection point 26, while opposite the injection point 26 is a full depth section 32. Thus, when a plane perpendicular to the roof portion passes through the injection point and a center of the roof portion the plane will intersect a recessed section 34 and a full-depth section 32.

Figure 9:
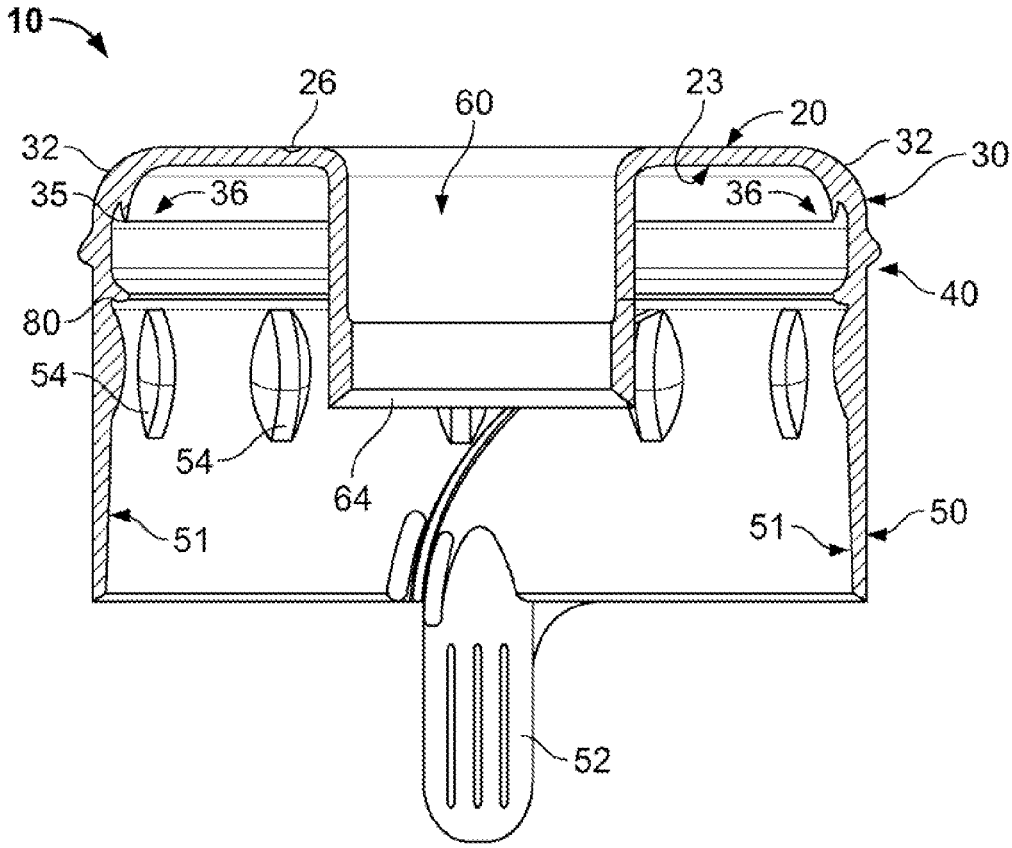
FIG. 9 is a sectional view through the closure of FIGS. 6*a* and 6*b*, taken substantially from the perspective of arrows A-A of FIG. 7*a;*
Figure 10:
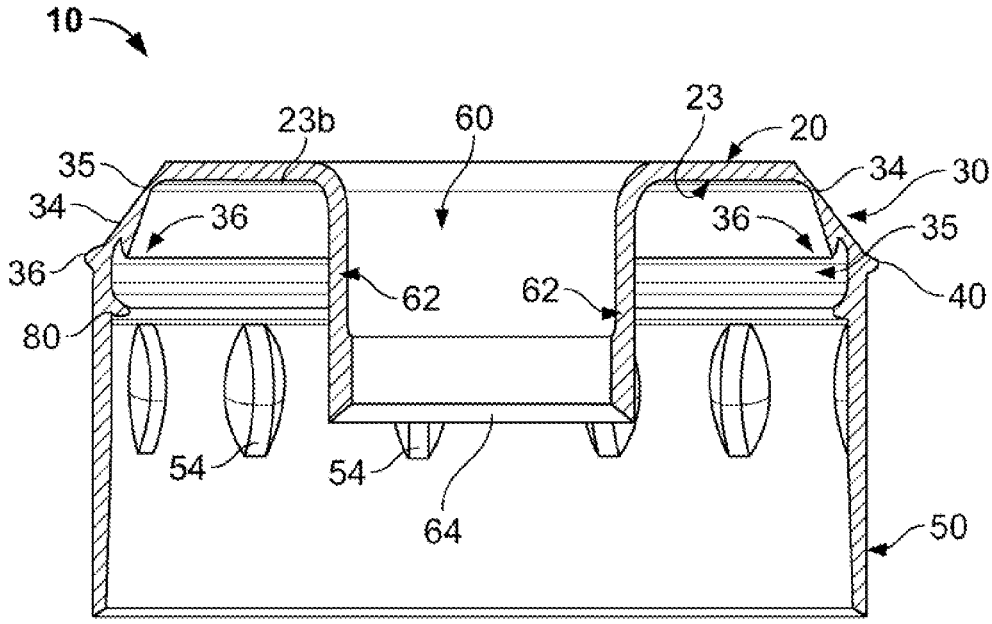
FIG. 10 is a sectional view through the closure of FIGS. 6*a* and 6*b*, taken substantially from the perspective of arrows B-B of FIG. 7*a*.

FIG. 9 shows a cross section through the closure 10, along line A-A, viewed in the direction of the arrows (as shown in FIG. 7*a*). FIG. 10 shows a cross section through the closure 10 along the line B-B, viewed in the direction of the arrows (as shown in FIG. 7*a*). In FIG. 9, the section through shoulder 30 passes through a full-depth wall section 32 on both sides. The generally rounded nature of the full-depth sections 32 is illustrated in this figure. In this particular embodiment the thickness of the full-depth wall sections 32 is substantially constant. However, this is not a requirement for the invention.

FIG. 9 also illustrates the arrangement of the injection point 26 in relation to an opposing full-depth wall section 32. The line of cross section (line A-A) passes from the injection point 26, over the center of roof 20 and terminates in the full-depth wall section 32.

In FIG. 10, the cross section through the shoulder 30 passes through a recess 34 on both sides. Comparing the cross sections of FIGS. 9 and 10, the reduction in the amount of material used at a recess 34 is readily apparent. The wall thickness at upper end 35 and lower end 36 of the recess 34 is substantially the same as the corresponding wall thickness of the full-depth wall section 32, shown in FIG. 9. However, as previously described, the external surface 31 of the shoulder 30 draws in at the recess 34 to a reduced thickness, which typically is about 0.5 mm or greater at the center of the recess.

The wall sections 32 have been described above as being "full-depth" or "normal thickness" wall sections. While it is preferable for the wall thickness of the shoulder 30 at the weld location 40 to be the full-depth dimension, an alternative embodiment provides this location with a wall thickness lying between a minimum thickness (as at the center of a recess 34) and a maximum thickness (as at wall section 32). In any case, the wall thickness at the location 40 needs to be sufficient to provide an effective weld, capable of withstanding the forces exerted when the closure is applied to a container neck. Accordingly, the references above to "full-depth" or "normal depth" wall sections are to be interpreted in a relative sense.

Although the embodiments described above have principally been taught using non-spill embodiments, the invention may equally be applied to flat roof closures. The structure of such a closure is substantially the same as that described above, except that, instead of a central well 60 and annular disc 22, the roof is formed by a substantially planar disc. Furthermore, for ease of manufacture, the injection point may be located at the center of the roof, so that the injection point is also located at the center. In this case, weld line concerns are greatly diminished.

The closure may further include a flow in liner material or disk cut liner 23*b* positioned against an interior portion 23 of the roof 20. The liner 23*b* helps provide a seal between the closure 10 and bottle during use.

Figure 11:
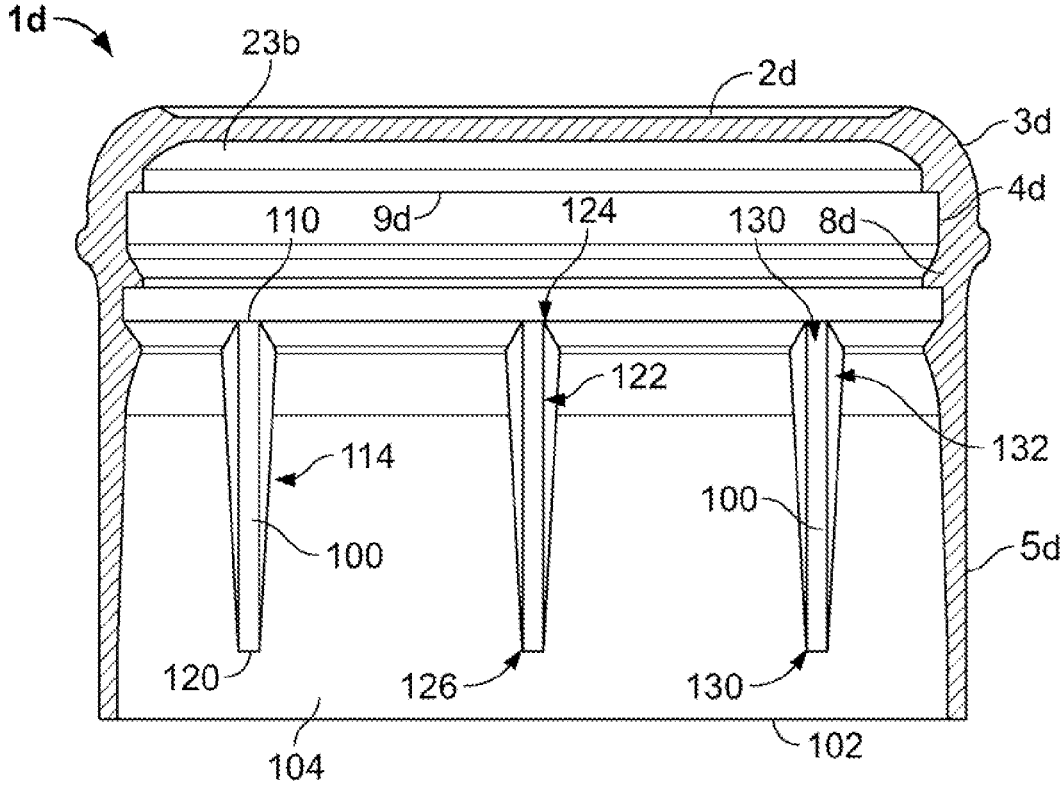
FIG. 11 is an embodiment showing yet another embodiment for a closure.

Turning now to FIG. 11, there is shown an embodiment of an additional improvement according to the invention. FIG. 11 shows a closure generally identified as 1*d* in side elevation and partial section. Most of the features shown in the FIG. 11 closure embodiment are conventional with one primary exception: the FIG. 11 embodiment includes one or more "extended application ramps" 100. The "extended application ramps" 100 are similar to the "application ramps" identified as 54 and 54*a* in FIGS. 1 and 2 respectively, yet are now extended downwardly on the closure skirt 5*d*. The FIG. 11 embodiment shows three extended application ramps 100 reflecting the downwardly extension. This extension is clear by comparison with those application ramps 54 and 54*a* illustrated in the prior art closures of FIGS. 1 and 2.

It is further noted that the sectional view of FIG. 11 shows the half of the closure opposite the half containing the release tab 7. In other words, the release tab 7 is positioned above the plane of the paper in the FIG. 11 view. Thus the "extended application ramps" 100 of FIG. 11 are positioned on the closure skirt portion opposite the half containing the release tab 7. Providing "extended application ramps" on the half of the closure skirt containing the release tab is optional.

As previously mentioned the upper edge 110 of the ramps extends about a tension ring 8*d*. However, the lower edge 120 has an elongated length that causes the lower edge 120 to be positioned about above the bottom edge 102 defined by the cylindrical skirt 5*d*. Preferably the lower edge 120 is about 50% to 25% above the bottom edge 102 measured against the entire length of the cylindrical skirt 5*d*.

Each of the ramps 100 includes a base 112 connected to the inner wall 104 of the cylindrical skirt 5*d* and includes a profile 114 that extends from the base 112. The profile 114 is defined as having a maximum thickness 122 at a position between the upper edge 110 and the lower edge 120 and diminishing continuously from the maximum thickness 122 to a first minimum thickness 124 substantially about the upper edge 110 and to a second minimum thickness 126 substantially at the lower edge 120. The profile 114 further slants from the maximum thickness 122 to the first 124 and second 126 minimum thicknesses. It is further contemplated by the present invention that the first and second minimum thicknesses are substantially the same. Furthermore, the maximum thickness 122 may be closer towards the upper edge 110.

In another embodiment the base 112 may be further defined as having a first width 130 defined about the upper edge 110 and the lower edge 110 and a second width 132 defined at a position between the upper and lower edges. While it is contemplated in having the first and second widths substantially the same, the second width 132 may be greater than the first width 130.

The importance of the downward extension of the "extended application ramps" 100 on that portion of the skirt opposite the release tab can be understood when one considers conventional practice most often used for applying these types of closures to containers. These push-on closures for large container necks are often applied by first orienting the closure in a chute. When the closure reaches the end of the chute, it assumes a position wherein the closure axis is inclined to the vertical with the lower edge of the closure skirt opposite the release tab disposed vertically lower than the lower edge of the closure skirt adjacent the release tab. It is held in this position by the release tab being retained in a slot. The container is passed beneath the positioned closure in such a way the container neck contacts that lower edge of the closure skirt opposite the release tab. Further movement of the container "picks" the closure from the chute such that the closure rests gently over the container neck, but often in an axially "skewed" position relative the container. The combination closure/container is then subjected to a top load force to push the closure down over the container neck to seal the container. However, as a result of the possible axially skewed condition of the closure at pickoff, the final push-on of the closure may not be uniform. Rather, the side of the closure skirt opposite the release tab gets pushed down first, followed by the closure portion containing the release tab. Thus the "extended application ramps" 100 on the closure skirt portion opposite the release tab assist in air venting at an earlier point in the capping process to promote improved capping performance. It is also believed that the extended application ramps 100 are an advantage because they assist the closure in leveling itself before it sets and is pushed down onto the neck.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred.

We claim:

1. A closure for a container, the closure comprising:

a roof portion having an exterior face and a continuous annular periphery;

a shoulder portion which merges with the annular periphery;

a skirt portion depending from the shoulder portion; and the shoulder portion comprising an external surface having at least one first section having a first wall dimension, and at least one scalloped recessed region having a second wall dimension less than the first wall dimension, the at least one scalloped recessed region further having a recessed length of varied depth horizontally oriented along the shoulder portion and below the roof portion, the recessed length being circumferentially positioned such that the scalloped recessed region is longer in its overall length than a maximum height along such length when the exterior face of the roof portion is horizontally oriented and upwardly facing.

2. The closure of claim 1 further comprising:

an injection point defined on said roof portion and the injection point corresponding to an injection site of an injection mold; and a location on the shoulder portion which is furthest from the injection point on the roof portion has disposed thereat one of the at least one first section having the first wall dimension.

3. The closure of claim 2, further comprising a weld joint, the weld joint being formed at the said one of the at least one first section of the shoulder portion having the first wall dimension.

4. The closure of claim 2, wherein the at least one first section and the at least one recessed region are arranged such that a plane perpendicular to the roof portion and passing through both the injection point and a center of the roof portion intersects the shoulder portion at the at least one first section.

5. The closure of claim 2, wherein the at least one first section and the at least one recessed region are arranged such that a plane perpendicular to the roof portion and passing through both the injection point and a center of the roof portion intersects the shoulder portion at the at least one first section and the at least one recessed region.

6. The closure of claim 4, wherein the plane intersects the shoulder portion on a side remote from the injection point at the at least one first section.

7. The closure of claim 3, wherein the weld joint is formed substantially in the plane on the side remote from the injection point.

8. The closure of claim 3, wherein the weld joint subtends the side remote from the injection point at an angle offset from a center position on said roof.

9. The closure of claim 8, wherein said angle is in a range of about 5 to 25 degrees.

10. The closure of claim 1, wherein the shoulder portion comprises three or more recessed regions and a corresponding number of first sections separating the recessed regions.

11. The closure of claim 1, wherein the shoulder portion includes at least one recessed portion which is angular.

12. The closure of claim 1, wherein the shoulder portion comprises a plurality of recessed regions spaced at equal intervals around the periphery of the shoulder portion.

13. The closure of claim 1, wherein the shoulder portion comprises a plurality of recessed regions separately spaced between two adjacent first sections.

14. The closure of claim 1, wherein said at least one recessed region has an outer edge and a recess centre, and a wall dimension of said recessed region varies smoothly from the first wall dimension at the outer edge to the second wall dimension at the recess centre.

15. The closure of claim 1, wherein the first wail dimension is generally about 2 mm.

16. The closure of claim 1, wherein the first wall dimension is greater than about 3 mm.

17. The closure of claim 1, wherein the first wall dimension is uniform along said shoulder portion.

18. The closure of claim 1, wherein the first wall dimension varies along said shoulder portion.

19. The closure of claim 1, wherein the second wall dimension is greater than about 0.5 mm.

20. The closure of claim 2, wherein the roof portion comprises an annular disc and a central well having a side wall depending from the annular disc, the injection point being disposed on the annular disc.

21. The closure of claim 2, wherein the roof portion comprises a substantially planar disc, the injection point being disposed on the disc at a centre of the roof portion.

22. The closure of claim 1 further including a liner positioned against an interior portion of the roof portion.

23. The closure of claim 1 in combination with a container wherein the container comprises a neck structure defining an opening, and an external neck surface having disposed thereon means for engagement, and the closure further includes means for complementary engagement disposed on an internal surface thereof for providing sealing engagement between the closure and the container neck structure.

24. The combination of claim 23, wherein the closure further includes a plurality of recessed regions spaced at equal intervals around the periphery of the shoulder portion.

25. The combination of claim 23, wherein said first section acts as a strut to maintain general rigidity of the closure during application to said container neck while permitting the closure to flex into snap engagement on said container neck.

26. The closure of claim 1 wherein the skirt portion has an outside skirt diameter and the at least one first section having a first wall dimension has an outside diameter greater than the outside skirt diameter.

* * * * *

UNITED STATES PATENT AND TRADEMARK OFFICE

CERTIFICATE OF CORRECTION

PATENT NO. : 8,646,635 B2
APPLICATION NO. : 12/981134
DATED : February 11, 2014
INVENTOR(S) : Gerry Mavin et al.

It is certified that error appears in the above-identified patent and that said Letters Patent is hereby corrected as shown below:

In The Claims:

Column 11, line 18, Claim 15,

"The closure of claim 1, wherein the first wail dimension" should read --The closure of claim 1, wherein the first wall dimension--

Signed and Sealed this
Fifth Day of August, 2014

Michelle K. Lee

Michelle K. Lee
*Deputy Director of the United States Patent and Trademark Office*